US006688709B1

(12) United States Patent
Ishola

(10) Patent No.: US 6,688,709 B1
(45) Date of Patent: Feb. 10, 2004

(54) SLIDING DESK ACCESSORY SUPPORT

(76) Inventor: Ganiyu Ishola, 134 - 101 Parkside Dr., Port Moody BC (CA), V3H 4W6

( * ) Notice: Subject to any disclaimer, the term of this patent is extended or adjusted under 35 U.S.C. 154(b) by 63 days.

(21) Appl. No.: 10/006,897

(22) Filed: Oct. 26, 2001

(51) Int. Cl.[7] ..... A47B 81/00
(52) U.S. Cl. ..... 312/208.1; 312/334.23
(58) Field of Search ..... 312/208.1, 208.2, 312/330.1, 334.1, 334.23, 334.24, 334.25, 334.26, 352; 248/318, 311.2

(56) References Cited

U.S. PATENT DOCUMENTS

| | | | | | |
|---|---|---|---|---|---|
| 600,742 | A | * | 3/1898 | Porter | 312/334.24 X |
| 732,271 | A | * | 7/1903 | Dunning | 312/334.26 |
| 3,746,418 | A | | 7/1973 | Barber, Jr. | |
| 4,140,355 | A | * | 2/1979 | Swain | 312/334.23 X |
| 4,288,137 | A | | 9/1981 | MacDonald | |
| 4,944,402 | A | * | 7/1990 | Wu | 206/581 |
| 5,019,124 | A | * | 5/1991 | Flugger | 206/564 |
| 5,213,401 | A | * | 5/1993 | Hatcher | 312/208.1 |
| 5,302,015 | A | | 4/1994 | Du Vall | |
| 5,595,428 | A | * | 1/1997 | Huang | 312/208.1 X |
| D382,156 | S | | 8/1997 | Huang | |
| 5,655,672 | A | * | 8/1997 | Stuchlik, III | 312/334.23 X |
| 5,704,698 | A | | 1/1998 | Lin | |
| 5,771,814 | A | | 6/1998 | Clausen | |
| 6,158,829 | A | * | 12/2000 | Nielsen | 312/208.1 |

FOREIGN PATENT DOCUMENTS

| | | | | |
|---|---|---|---|---|
| DE | 804848 | * | 4/1951 | 312/334.23 |
| FR | 1260938 | * | 4/1961 | 312/334.8 |

* cited by examiner

*Primary Examiner*—James O. Hansen

(57) ABSTRACT

A sliding desk accessory support for mounting on an underside of the desk to provide a conveniently positionable retractable support for frequently used items. The sliding desk accessory support includes a support for supporting an accessory. The support has a support surface for resting the accessory thereon. A slider is provided for mounting the support on the underside of a desk in a manner permitting substantially linear movement of the support with respect to the desk. The slider is positioned between the support surface of the support and the underside of the desk when the slider is mounted on the desk for minimizing the lateral extent of the invention when installed.

21 Claims, 5 Drawing Sheets

SLIDING DESK ACCESSORY SUPPORT

BACKGROUND OF THE INVENTION

1. Field of the Invention

The present invention relates to desk accessory supports and more particularly pertains to a new sliding desk accessory support for mounting on an underside of the desk to provide a conveniently positionable retractable support for frequently used items.

2. Description of the Prior Art

The use of desk accessory supports is known in the prior art. Typically, these known desk accessory supports employ a tray with dual guidance tracks that are each mounted on a lateral side of the tray, and thus the guide tracks generally extend laterally outward from the tray. The laterally extending guide tracks thus require greater lateral under desk space than is merely occupied by the tray, and therefore the known desk accessory supports may not be able to be used in areas where the under desk space is limited in a lateral direction.

Further, the dual guide tracks of the known desk accessory supports can be difficult to install on the under side of the desk since the guide tracks must be mounted on the desk in a parallel orientation with respect to each other. However, if the guide tracks are not installed in a parallel orientation, the tray may bind as it moves along the guide tracks or may not move at all. Mounting the tracks in a parallel orientation is made more difficult by the fact that the mounted must be accomplished on the inverted surface of the underside of the desk, which can be difficult to access.

The sliding desk accessory support according to the present invention substantially departs from the conventional concepts and designs of the prior art, and in so doing provides an apparatus primarily developed for the purpose of mounting on an underside of the desk to provide a conveniently positionable retractable support for frequently used items.

SUMMARY OF THE INVENTION

In view of the foregoing disadvantages inherent in the known types of desk accessory supports now present in the prior art, the present invention provides a new sliding desk accessory support construction wherein the same can be utilized for mounting on an underside of the desk to provide a conveniently positionable retractable support for frequently used items.

The present invention generally comprises a support for supporting an accessory. The support has a support surface for resting the accessory thereon. A slider is provided for mounting the support on the underside of a desk in a manner permitting substantially linear movement of the support with respect to the desk. The slider is positioned between the support surface of the support and the underside of the desk when the slider is mounted on the desk for minimizing the lateral extent of the invention when installed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
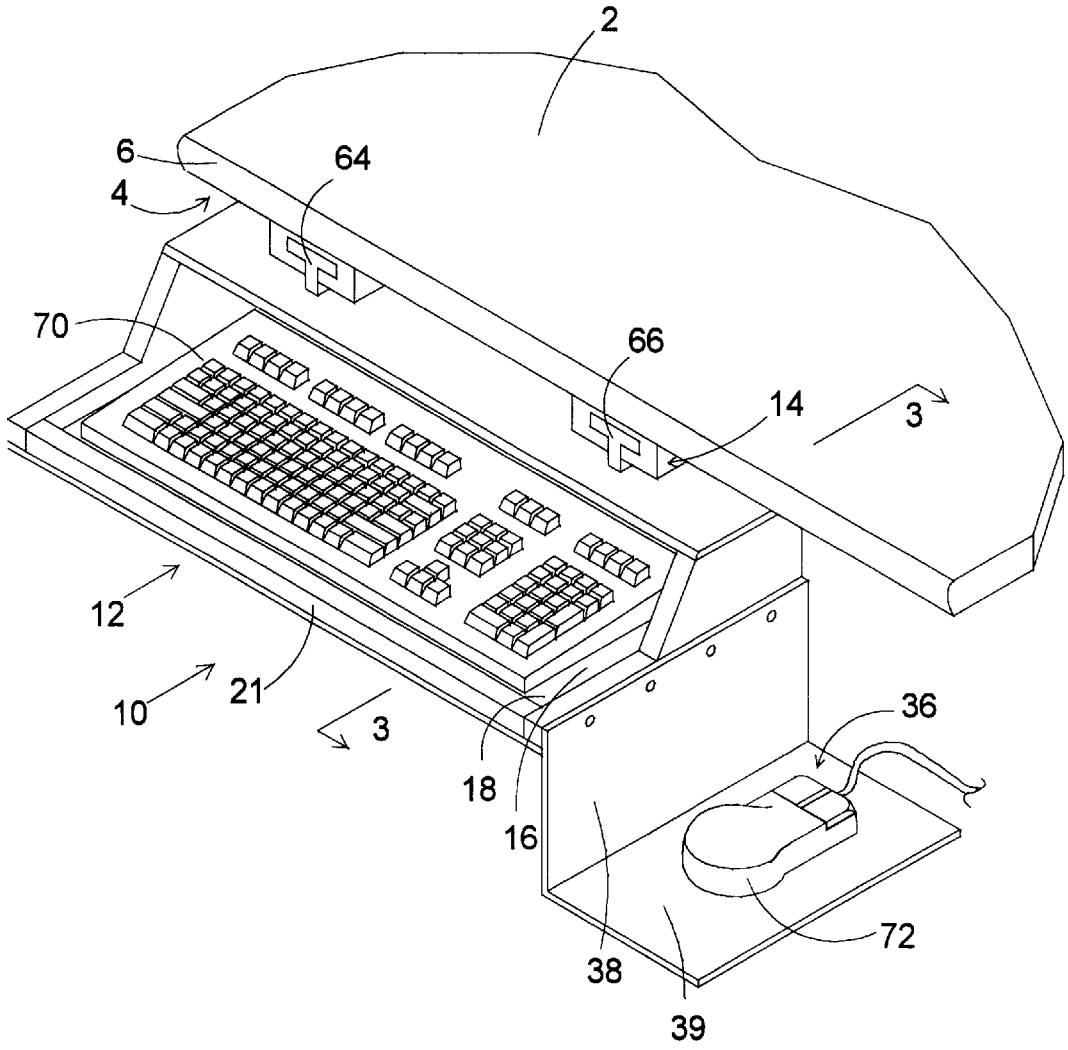
FIG. 1 is a schematic perspective view of a new sliding desk accessory support according to the present invention.
Figure 2:
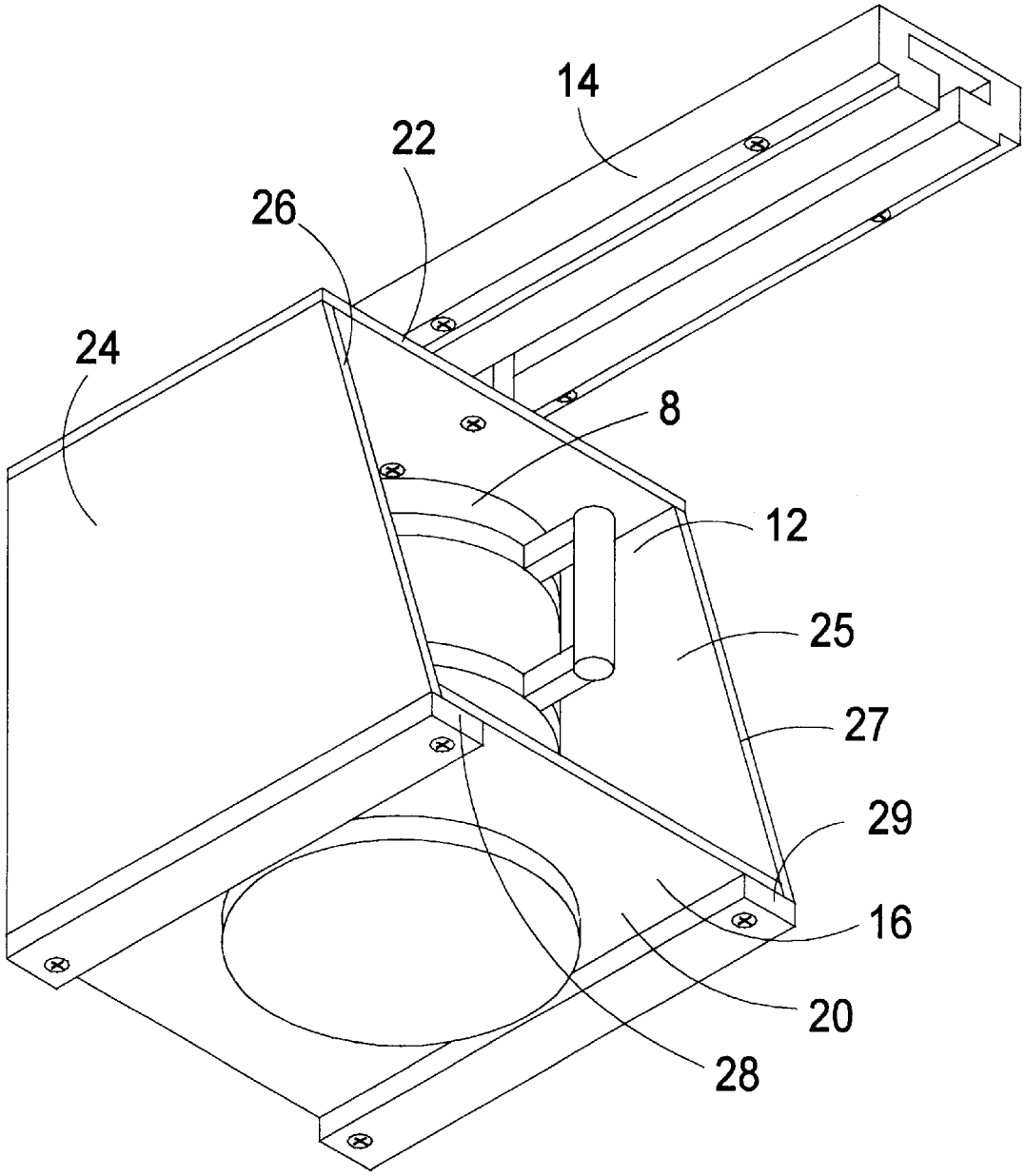
FIG. 2 is a schematic perspective view of a variation of the present invention.
Figure 3:
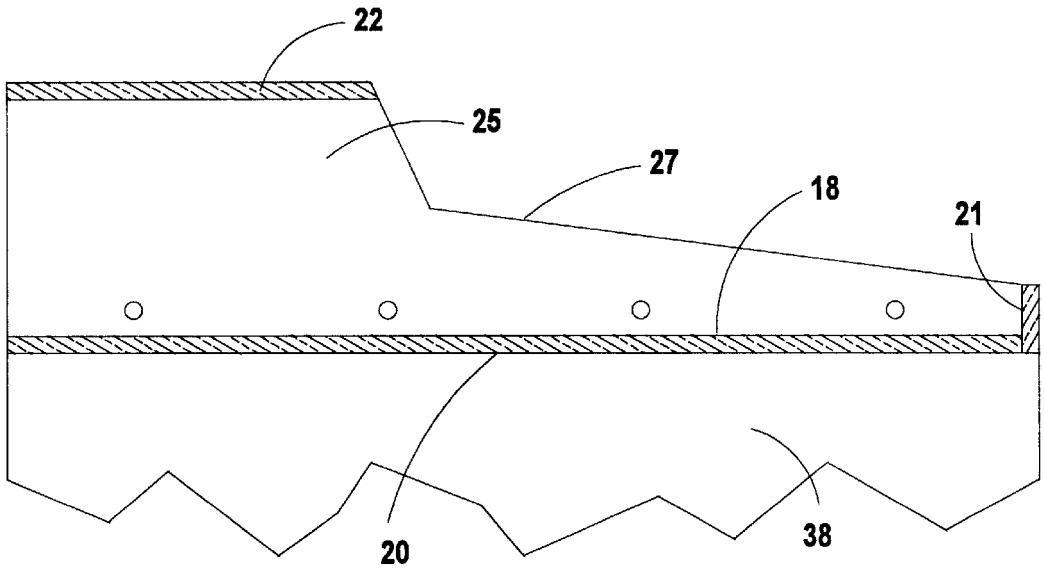
FIG. 3 is a schematic sectional view of the present invention taken along line 3—3 of FIG 1.
Figure 4:
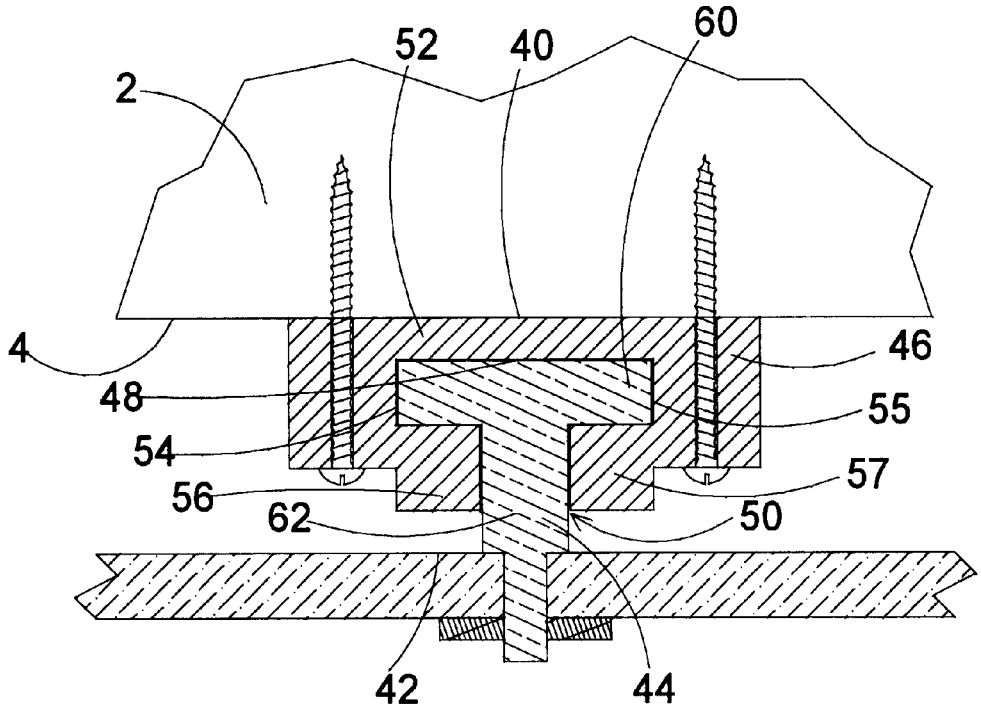
FIG. 4 is a schematic sectional view of the slider of the present invention.
Figure 5:
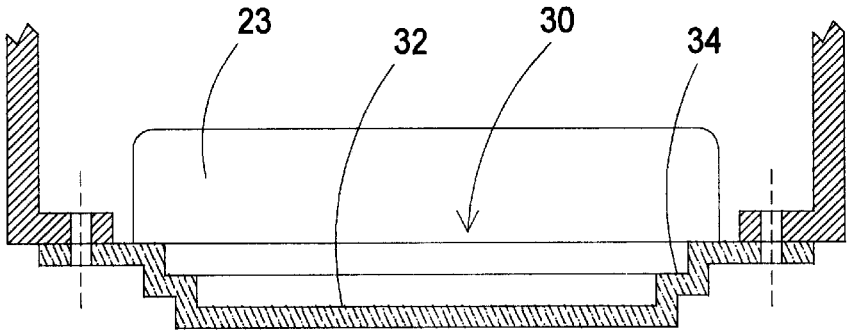
FIG. 5 is a schematic sectional view of a lower portion of the support of the present invention particularly illustrating the depression in the lower panel.

With reference now to the drawings, and in particular to FIGS. 1 through 5 thereof, a new sliding desk accessory support embodying the principles and concepts of the present invention and generally designated by the reference numeral 10 will be described.

As best illustrated in FIGS. 1 through 5, the sliding desk accessory support assembly 10 generally comprises support means, or a support 12, for supporting an accessory, and slider means, or a slider 14, for mounting the support means on the underside of a desk 2 in a manner permitting substantially linear movement of the support with respect to the desk. The slider is positioned between the support surface of the support and an underside 4 of the desk when the slider is mounted on the desk.

The sliding desk accessory support assembly 10 is adapted for mounting on the underside 4 of a desk 2 having a forward edge 6 such that the accessory may be selectively slid between positions in front of, and behind, the forward edge of the desk.

The support 12 has a support surface 16 for resting the accessory thereon. The support 12 includes a primary support structure 18, which is especially suitable for supporting accessories such as, for example, computer keyboards, calculators, beverage containers, and other accessories that may need to be frequently accessed but would otherwise clutter an upper surface of a desk.

The primary support structure 18 may comprise a lower panel 20 having the support surface 16 thereon, an upper panel 22, and a pair of side panels 24, 25 extending downwardly from the upper panel. The lower panel 20 extends between and is mounted on the side panels 24, 25 in a spaced condition from the upper panel 22. The side panels 24, 25 may be positioned in a spaced, substantially parallel condition. The side panels 24, 25 may be positioned in a substantially perpendicular relationship with respect to the upper and lower panels. Optionally, a front panel 21 may be attached to a forward edge of the lower panel 20 to prevent movement of items, such as a keyboard, past the forward edge of the lower panel.

The side panels 24, 25 each have a forward edge 26, 27, and optionally a portion of the lower panel extends forwardly of the front edges of the side panels such that the support surface extends forward of an interior formed by the upper and side panels. As a further option, the forward edges of the side panels may slope downwardly and forwardly from the upper panel to the lower panel.

Optionally, a ledge panel 28, 29 may be provided that extends inwardly from each of the side panels 24, 25 toward the opposite side panel. The lower panel 20 is rested on and spans between the ledge panels of the side panels. Each of the ledge panels may be mounted to the respective side panel adjacent to a lower edge of the side panel.

As yet a further option, the support surface 16 on the lower panel may have a depression 30 formed therein for receiving a lower portion of a beverage container 8 to resist slippage of the container with respect to the support surface. The depression may be substantially circular. The depression has a bottom face 32. The depression may include an annular shoulder 34 located between the bottom face 32 and the support surface 16, such that the bottom face has first, relatively smaller diameter, and the annular shoulder has a second, relatively larger diameter. By this structure, containers of various diameter sizes may be accommodated by the depression, with the container resting on the bottom face or on the annular shoulder.

The support 12 of the invention may include a computer cursor control device support structure 36 for supporting a computer cursor control device such as, for example, a mouse, trackball, or touchpad. The control device support structure 36 may be mounted on the primary support structure 18. The control device support structure preferably extends laterally from the primary support structure. The control device support structure may comprise a depending panel 38 and a cantilever panel 39. The depending panel may be mounted on the primary support structure, and depend downward from the primary support structure. The depending panel 38 may be fastened to one of the side panels of the primary support structure. Illustratively, a plurality of fasteners may pass through the depending panel and the one side panel of the primary support structure. The cantilever panel 39 extends from the depending panel, and preferably may extend in a substantially perpendicular relationship with respect to the depending panel.

The slider 14 has a top 40 mountable on the undersurface of the desk, and also has a bottom 42 mounted on the support. The slider generally comprises a slider assembly including a shuttle portion 44 mounted on a track portion 46, with the shuttle portion being slidable along a length of the track portion. The track portion 46 is mountable on the underside 4 of the desk 2 and the shuttle portion 44 is mounted on the support 12.

Illustratively, the track portion 46 may have a channel 48 formed therein and a section of the shuttle portion is complementarily shaped to slide in the channel of the track portion. The channel 48 of the track portion may have a substantially T-shaped lateral cross section and the section of the shuttle portion has a substantially T-shaped lateral cross section. The channel 48 has an elongate slot opening 50 on a lower surface of the track portion. The track portion may include a top wall 52, a pair of spaced and substantially parallel side walls 54, 55 extending downwardly from the top wall, and a pair of lip walls 56, 57 that each extend inwardly from the side walls toward the other of the lip walls.

Illustratively, the shuttle portion 44 may include a transverse wall 60 and a linking wall 62 extending between the transverse wall and the support 12. The linking wall 62 may be mounted on the support 12. The slider means may comprise a single slider assembly 64 located a central lateral location on the support. The slider means may also comprise a pair of laterally spaced slider assemblies 64, 66, with each slider assembly being located on a lateral side of a central location on the support, such as, for example, in the case of a support supporting a keyboard or other laterally elongated desk accessory.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sliding accessory support for mounting on an underside of a desk having a forward edge, the accessory. support comprising:

a support for supporting an accessory, the support having a support surface for resting the accessory thereon, the support comprising:

a lower panel having the support surface thereon;

a pair of side panels extending upwardly from the lower panel; and an upper panel extending between the pair of side panels:

wherein the upper panel and the pair of side panels define an accessory receiving space above the support surface that is bounded by the panels;

wherein the accessory storage space is substantially open in a forward direction and a rearward direction; and slider means for mounting the support on the underside of the desk in a manner permitting substantially linear movement of the support with respect to the desk, the slider being positioned between the support surface of the support and the underside of the desk when the support is mounted on the desk.

2. The sliding accessory support of claim 1 wherein the side panels are in a spaced, substantially parallel condition, and wherein the side panels are in a substantially perpendicular relationship with respect to the upper and lower panels.

3. The sliding accessory support of claim 1 wherein the side panels each have a forward edge, and a portion of the lower panel extends forwardly of the front edges of the side panels such that the support surface extends forward of an interior formed by the upper and side panels.

4. The sliding accessory support of claim 1 wherein the side panels each have a forward edge, and the forward edges of the side panels slope forwardly from the upper panel to the lower panel.

5. The sliding accessory support of claim 1 wherein a ledge panel extends inwardly from each of the side panels toward the opposite side panel, the lower panel resting on and spanning between the ledge panels of the side panels.

6. The sliding accessory support of claim 1 wherein the support surface on the lower panel has a depression formed therein for receiving a lower portion of a beverage container.

7. The sliding accessory support of claim 6 wherein the depression has a bottom face, the depression including a shoulder between the bottom face and the support surface.

8. The sliding accessory support of claim 1 wherein the support means includes a computer cursor control device support structure, the control device support structure being mounted on the primary support structure, the control device support structure extending laterally from the primary support structure.

9. The sliding accessory support of claim 8 wherein the control device support structure comprises:

a depending panel mounted on and depending from the primary support structure the depending panel depending from the primary support structure; and a cantilever panel extending from the depending panel, the cantilever panel extending in a substantially perpendicular relationship with respect to the deppending panel.

10. The sliding accessory support of claim 1 wherein the slider means has a top mountable on the undersurface of the desk, the slider means having a bottom mounted on an un upper side of the upper panel of the support.

11. The sliding accessory support of claim 1 wherein the slider means comprises a slider assembly including a shuttle portion mounted on a track portion, the shuttle portion being slidable along a length of the track portion, wherein the track portion is mountable on the underside of the desk and the shuttle portion is mounted on an upper side of the upper panel of the support.

12. The sliding accessory support of claim 11 wherein the track portion has a channel formed therein and a section of the shuttle portion is complementarily shaped to slide in the channel of the track portion.

13. The sliding accessory support of claim 12 wherein the channel of the track portion has a substantially T-shaped lateral cross section and the section of the shuttle portion has a substantially T-shaped lateral cross section.

14. The sliding accessory support of claim 12 wherein the channel has an elongate slot opening on a lower surface of the track portion.

15. The sliding accessory support of claim 11 wherein the track portion includes a top wall, a pair of spaced, substantially parallel side walls extending downwardly from the top wall, and a pair of lip walls each extending inwardly from the side walls toward the other of the lip walls.

16. The sliding accessory support of claim 11 wherein the shuttle portion includes a transverse wall and a linking wall extending between the transverse wall and the support, the linking wall being mounted on the support.

17. The sliding accessory support of claim 11 wherein the slider comprises a single slider assembly located at a central lateral location on the support.

18. The sliding accessory support of claim 11 wherein the slider means comprises a pair of laterally spaced slider assemblies each located on a lateral side of a central location on the support means.

19. The sliding accessory support of claim 1 wherein the upper panel of the support is substantially coextensive with the support surface of the lower panel.

20. A sliding accessory support for mounting on an underside of a desk having a forward edge, the accessory support comprising:

support for supporting an accessory, the support having a support surface for resting the accessory thereon;

wherein the support includes a primary support structure, the primary support structure comprising:

a lower panel having the support surface thereon, an upper panel, a pair of side panels extending downwardly from the upper panel, the lower panel being mounted on each of the side panels in a spaced condition from the upper panel;

wherein the side panels are in a spaced, substantially parallel condition;

wherein the side panels are in a substantially perpendicular relationship with respect to the upper and lower panels;

wherein the side panels each have a forward edge, and the forward edges of the side panels slope forwardly from the upper panel to the lower panel;

wherein a ledge panel extends inwardly from each of the side panels toward the opposite side panel, the lower panel resting on and spanning between the ledge panels of the side panels, each of the ledge panels being mounted to the respective side panel adjacent to a lower edge of the side panel;

wherein the support surface on the lower panel has a depression formed therein for receiving a lower portion of a beverage container, the depression being substantially circular, the depression having a bottom face, the depression including an annular shoulder between the bottom face and the support surface;

slider for mounting the support on the underside of the desk in a manner permitting substantially linear movement of the support means with respect to the desk, the slider being positioned between the support surface of the support and the underside of the desk when the support means is mounted on the desk;

wherein the slider a means has a top mountable on the undersurface of the desk, the slider means having a bottom mounted on the support means;

wherein the slider means comprises a slider assembly including a shuttle portion mounted on a track portion, the shuttle portion being slidable along a length of the track portion;

wherein the track portion is mountable on the underside of the desk and the shuttle portion is mounted on the support means;

wherein the track portion has a channel formed therein and a section of the shuttle portion is complementarily shaped to slide in the channel of the track portion;

wherein the channel of the track portion has a substantially T-shaped lateral cross section and the section of the shuttle portion has a substantially T-shaped lateral cross section;

wherein the channel has an elongate slot opening on a lower surface of the track portion;

wherein the track portion includes a top wall, a pair of spaced, substantially parallel side walls extending downwardly from the top wall, and a pair of lip walls each extending inwardly from the side walls toward the other of the lip walls;

wherein the shuttle portion includes a transverse wall and a linking wall extending between the transverse wall and the support means, the linking wall being mounted on the support means.

21. In combination:

a desk having a substantially horizontally oriented top panel having an underside, the top panel having a forward edge; and a sliding accessory support mounted on the underside of the top panel of the desk having a forward edge, the accessory support comprising:

a support for supporting an accessory, the support having a support surface for resting the accessory thereon, the support comprising:

a lower panel having the support surface thereon;

a pair of side panels extending upwardly from the lower panel; and an upper panel extending between the pair of side panels;

wherein the upper panel and the pair of side panels define an accessory receiving space above the support surface that is bounded by the panels;

wherein the accessory storage space is substantially open in a forward direction and a rearward directions; and slider means mounting the support on the underside of the desk in a manner permitting substantially linear movement of the support with respect to the desk, the slider means being positioned between the support surface of the support and the underside of the desk.

* * * * *